US005973286A

United States Patent [19]

Wan

[11] Patent Number: 5,973,286

[45] Date of Patent: Oct. 26, 1999

[54] GRAIN SORTING METHOD AND A DEVICE THEREOF

[75] Inventor: Ye-Nu Wan, Taichung, Taiwan

[73] Assignee: Council of Agriculture Executive Yuan, Taipei, Taiwan

[21] Appl. No.: 08/998,575

[22] Filed: Dec. 29, 1997

[30] Foreign Application Priority Data

Dec. 30, 1996 [TW] Taiwan ..... 85116292

[51] Int. Cl.[6] ..... B07C 5/342

[52] U.S. Cl. ..... 209/582; 209/254; 209/587; 209/939

[58] Field of Search ..... 209/577, 580, 209/581, 587, 639, 938, 939, 254, 582

[56] References Cited

U.S. PATENT DOCUMENTS 5,135,114 8/1992 Satake et al. ..... 209/587 X
5,713,473 2/1998 Satake et al. ..... 209/580
5,735,402 4/1998 Pezzoli et al. ..... 209/587 X

FOREIGN PATENT DOCUMENTS 55-60841 5/1980 United Kingdom ..... 209/580

*Primary Examiner*—Tuan N. Nguyen
*Attorney, Agent, or Firm*—Rosenberg, Klein & Lee

[57] ABSTRACT

A grain sorting method and a device is provided which serves to continuously and quickly detect the appearance quality of the grains. The grain sorting device includes a feeding mechanism and a scattering mechanism where the grains are separately scattered over the surface of a conveying belt. The conveying belt serves to transfer the grains to a photographing section where they are photographed and inspected by an electric coupling device. Various parameters of the grains are calculated and the inspected results are compared with data stored in a computer. The grains are then sorted into different classifications and respectively collected by a discharging device.

6 Claims, 5 Drawing Sheets

GRAIN SORTING METHOD AND A DEVICE THEREOF

BACKGROUND OF THE INVENTION

The present invention relates to a grain sorting method and a device thereof which is used to continuously inspect and compare the appearance quality of the grains for sorting the same.

With respect to the grains such as rice and wheat, after harvested, the grains must be further processed before consumption. With rice exemplified, the rice grain must be first de-husked into brown rice. The brown rice then is processed into milled rice by removing its bran. Generally, the quality of rice is inspected with the brown rice as a standard. However. the existing rice inspecting method is applied by man. The objectivity of manual inspecting and the manual grading efficiency are major problems. Thus, it is necessary to develop a new method and machine to solve these problems. The existing rice inspecting machines only include color separation machine and single rice kernel sorting machine. These two machines will be described as follows:

1. The color separation machine is used in the end of a rice milling process for separating the abnormally colored rice kernel from the polished rice kernel. The milled rice kernels arranged as rows fall into in an inspecting room in which two sets of illuminating device and photoactive identifying device are installed. A fluorescent tube in the inspecting room is used to illuminate the rice kernels passing through. A color board is provided as a background for the rice kernels. A sensing section serves to detect the reflection light and refraction light of the rice kernel. Due to difference from the background color, the abnormally colored rice grain will be sensed by the photoelectric sensors. A controller will then activate an air nozzle for blowing high speed air to remove the abnormally colored rice kernel and only the polished rice kernel can pass through.

2. The single kernel sorting machine is used to identify five qualities of good (sound) kernel, immature kernel, damaged kernel, dead kernel and discolored kernel from each other. The machine is composed of a passing head, light splitting head and fissuring head. After the rice kernels are illuminated by the light, according to the gray level data obtained by the three detectors, the passing ratio, light splitting ratio and fissuring extent of the rice kernels are measured. Then a microcomputer generally processes and compares the detected value and grade standard value. Thereafter, the five classifications of good (sound) kernel, immature kernel, damaged kernel, dead kernel and discolored kernel are identified from each other. Finally, according to the identification result and the mixing ratio, the rice kernels are sorted into four grades.

However, the color separating machine employs the photoelectric sensor to compare the color difference between the milled rice kernels so as to remove the abnormally colored ones. This measure is not suitable for inspection of quality of rice or other grains. On the other hand, the single kernel sorting machine also employs the photoelectric measure to detect the color of the rice kernels but cannot detect the shape difference among the rice kernels. Therefore, the brown rice can be only substantially divided into five classifications and it is impossible to accurately sort the rice kernels. Therefore, the single kernel sorting machine is only applicable to preliminary sorting for brown rice. Moreover, such machine can only identify one single rice kernel at one time.

SUMMARY OF THE INVENTION

In order to obviate the above problems, it is a primary object of the present invention to provide a grain sorting method and a device thereof which serves to continuously inspect and compare the appearance quality of the grains so as to sort the same at high efficiency.

The present invention can be best understood through the following description and accompanying drawings, wherein:

DETAILED DESCRIPTION OF THE PREFERRED EMBODIMENTS

Figure 1:
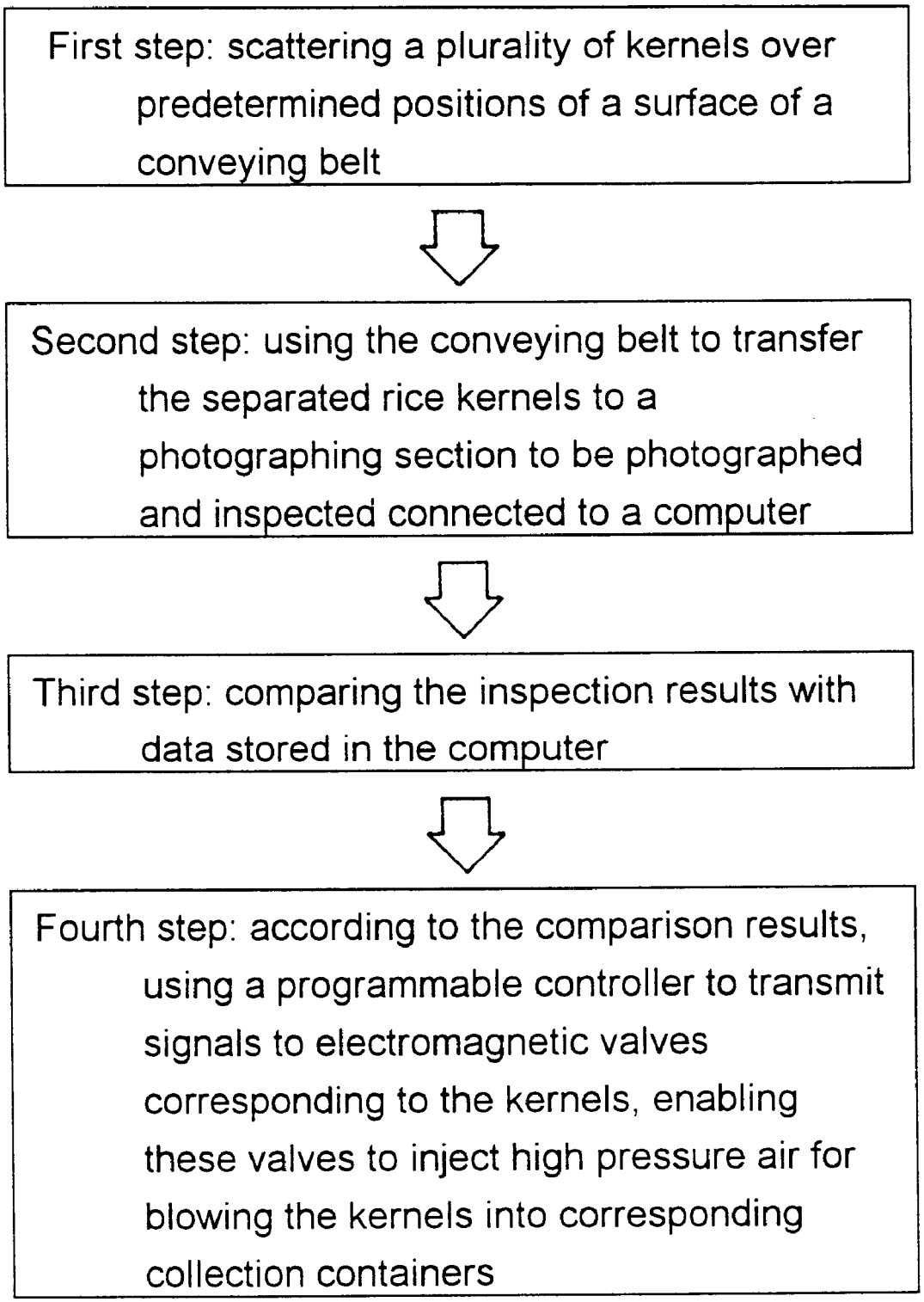
FIG. 1 is a flow chart of the sorting method of the present invention.

Please refer to FIG. 1 which shows a flow chart of the grain sorting method of the present invention applied to the brown rice. The method includes the following steps:

1. A plurality of rice kernels are separately planely scattered over predetermined positions of the surface of a conveying belt and oriented in the same direction.

2. The conveying belt transfers the separated rice kernels to a photographing section to be photographed and inspected by an electric coupling device connected to a computer.

3. Multiple references are taken out and the inspection results are compared with the data stored in the computer. Through a judgment, the rice grains are sorted into different classifications.

4. According to the comparison results, a programmable controller transmits signals to electromagnetic valves corresponding to the classification of rice kernels, enabling these valves to inject high pressure air for blowing the rice kernels into corresponding collection containers.

In the photographing section, the electric coupling device takes pictures of the rice grains on the conveying belt. After calculated by the computer, multiple references are taken out, such as projection area, ratio of projection area to perimeter, compactness, long/short axis ratio after Hotelling transfer, the sum of differences between four subsidiary short axes and main short axes, the sum of absolute values of differences between four subsidiary short axes and main short axes, mean value of red gray level, mean value of green gray level, mean value of blue gray level, standard deviation of red gray level, standard deviation of green gray level, standard deviation of blue gray level, the ratio of green light component to red light component, chalky area ratio, etc. Through a judgment, the rice kernels are divided into eight classifications: sound kernels, discolored kernels, chalky kernels, off-typed kernels, rusty kernels, immature kernels, abnormal kernels and rice screenings.

Accordingly, after the rice kernels are transferred to the photographing section for photographing and inspection, the inspection results are transmitted to the programmable controller by the computer via RS-232. When the rice kernels enter the discharging section, after the inspection result data are logically calculated by the programmable controller, the electromagnetic valves for the respective classifications of rice kernels are correctly activated to blow the rice kernels into the conveying guide tube. The rice kernels then fall down into the collection containers to complete the sorting operation.

Figure 2:
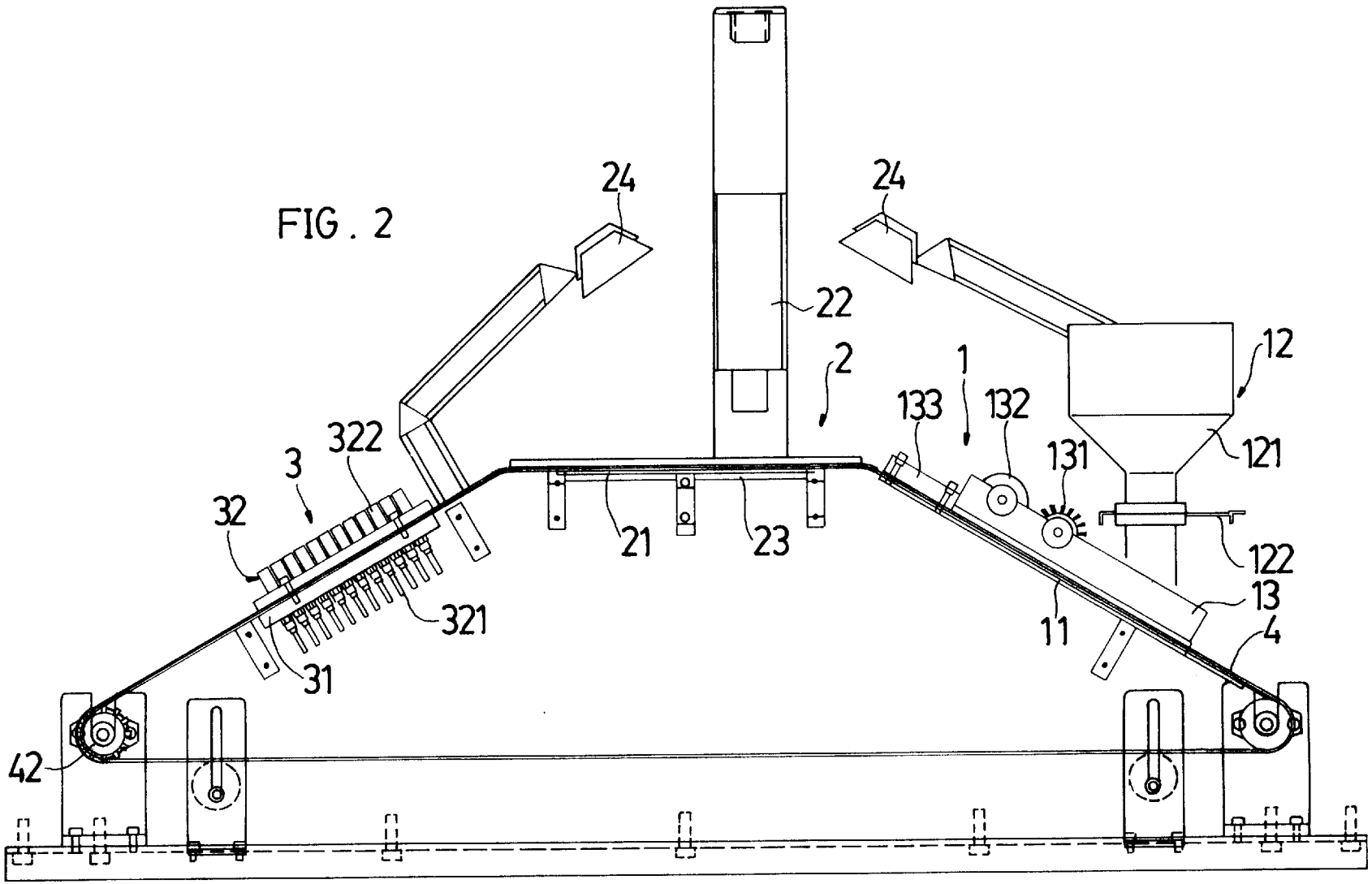
FIG. 2 is a side view showing an embodiment of the sorting device of the present invention.

Referring to FIG. 2, the above sorting operation is achieved by a sorting device as described hereinbelow. The sorting device has a substantially trapezoid profile, including a feeding section 1 having a retaining board 11, a photographing section 2 having a top board 21 and a discharging section 3 having a grading guide board 31. A conveying belt 4 is wound around the three boards and driven by a motor 42. The conveying belt 4 is formed with multiple rice kernel carrying holes 41 having a profile similar to that of the rice kernels. The carrying holes 41 are spaced from each other and oriented in the same direction. The retaining board 11 is upward inclined and is disposed with a feeding mechanism 12 and scattering mechanism 13. The top board 21 is disposed with a photographing device 22. The grading guide board 31 is disposed with a discharging device 32 including electromagnetic valves (not shown), injection nozzles 321 and rice kernel transferring guide tube 322. The nozzle 321 can be aligned with the carrying hole 41 and the opening/closing of the air flow of the nozzle 321 is controlled by the electromagnetic valve for blowing the rice kernels into the transferring guide tube 322. The rice kernels then move along the transferring guide tube 322 to fall into the collection container (not shown).

Figure 3:
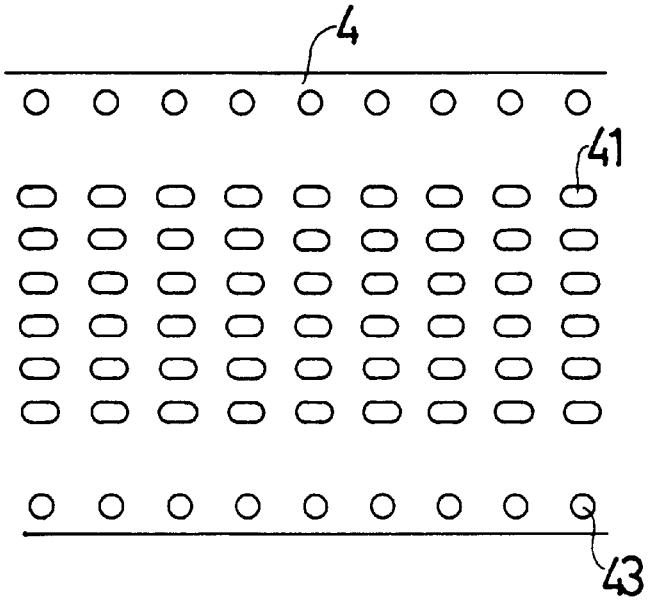
FIG. 3 is a top view according to FIG. 2, showing the rice kernel carrying holes of the conveying belt.

Referring to FIG. 3, the carrying hole 41 of the conveying belt 4 has an elliptic shape. The long axis of the carrying hole 41 is parallel to the moving direction of the conveying belt for restricting the orientation of the rice kernel. Two side of the conveying belt 4 are formed with counting holes 43 in alignment with the carrying holes 41 for counting the moving positions of the rice kernels.

Figure 4:
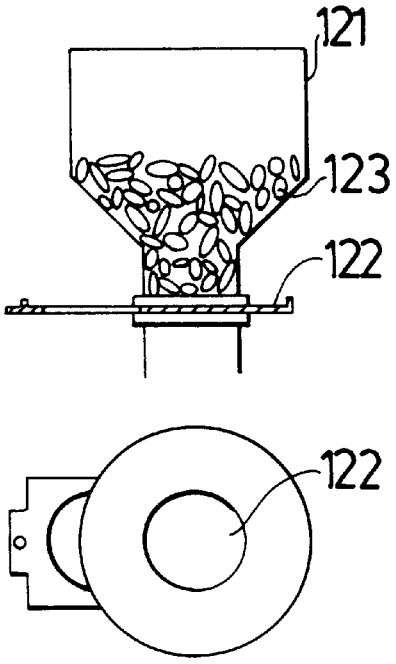
FIG. 4 shows the rice kernel container of the feeding mechanism of the embodiment of FIG. 2, in which the rice kernel container is closed.
Figure 5:
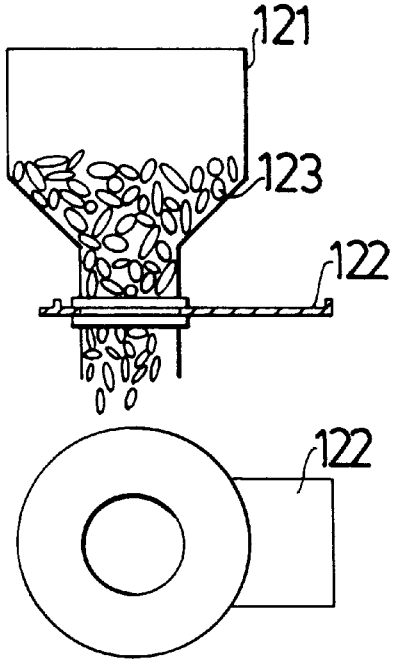
FIG. 5 shows the rice kernel container of the feeding mechanism of the embodiment of FIG. 2, in which the rice kernel container is opened.

Referring to FIGS. 4 and 5, the feeding mechanism 12 includes a funnel-shaped rice kernel container 121 having a gate 122 at lower end. The gate 122 is manually or electrically operable for controlling the amount of the falling rice kernels 123. With respect to the rice grains falling onto the conveying belt 4, the upward inclined board 11 has such an inclination that the rice kernels failing to get into the carrying holes 41 will slip down along the upper surface of the conveying belt 4 due to their own weight. Therefore, only the rice kernels getting into the carrying holes 41 can move upward along with the conveying belt 4.

Figure 6:
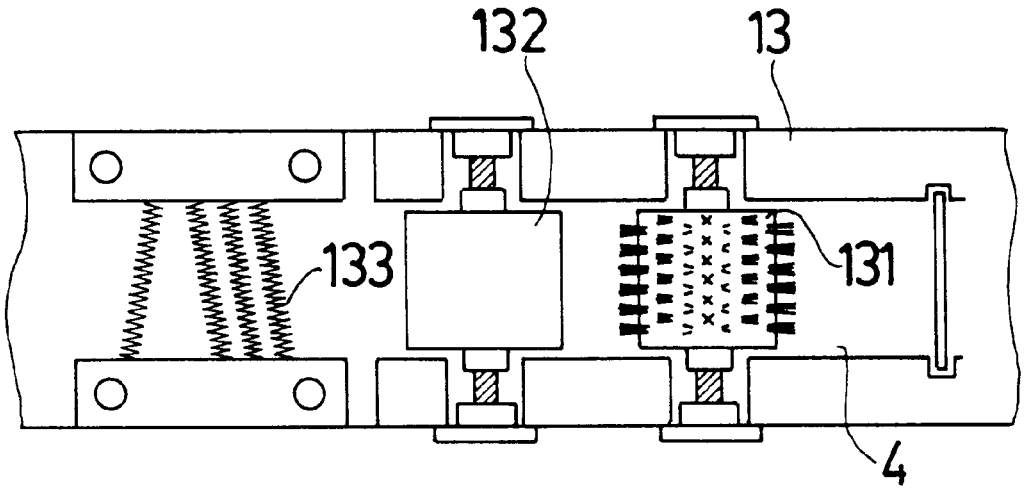
FIG. 6 is a top view of the scattering mechanism of the embodiment of FIG. 2.
Figure 7:
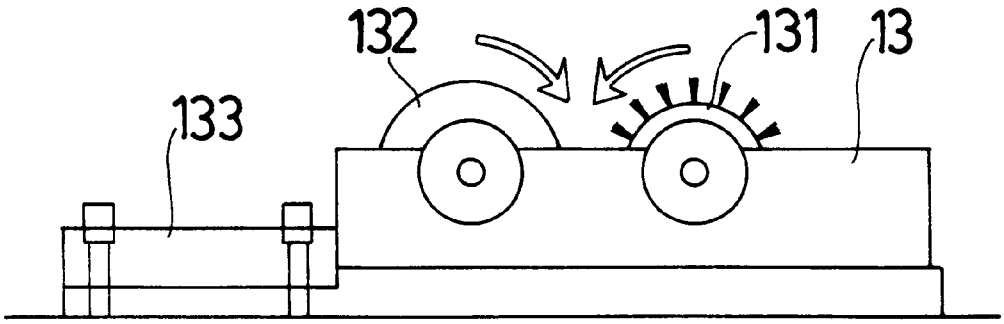
FIG. 7 is a side view of the scattering mechanism of the embodiment of FIG. 2.

Referring to FIGS. 6 and 7, the scattering mechanism 13 is positioned in front of the container 121, including a rotary brush 131 and a pressing wheel 132 which are driven by a motor (not shown) to rotate in reverse directions. The ends of the hairs of the rotary brush 131 contact with the conveying belt 4 for brushing off the excessive rice kernels on the conveying belt 4. The pressing wheel 132 is disposed with an outer layer of sponge and is rotated with a tangential speed faster than that of the conveying belt 4 so as to press the rice kernels, which fall into the carrying holes 41 but fail to horizontally lie therein, to properly lie in the carrying holes 41 in a horizontal state. Multiple springs 133 are disposed in front of the pressing wheel 132 across the conveying belt 4. The springs 133 contact with the conveying belt 4 so as to slightly vibrate the conveying belt 4 for making the rice kernels completely lie in the carrying holes 41 in a horizontal state.

In FIG. 2, the top board 21 of the photographing section 2 is made of a piece of transparent glass and a dark color board 23 is disposed thereunder as a background for the rice kernels. Illuminating devices 24 are disposed above two sides of the photographing device 22 for evenly illuminating the article to be photographed (that is, the rice kernels). The transparent top board 21 facilitates the illumination from lower side for detecting the broken grains. Also, the hardness of the glass-made top board is anti-abrasion.

Figure 8:
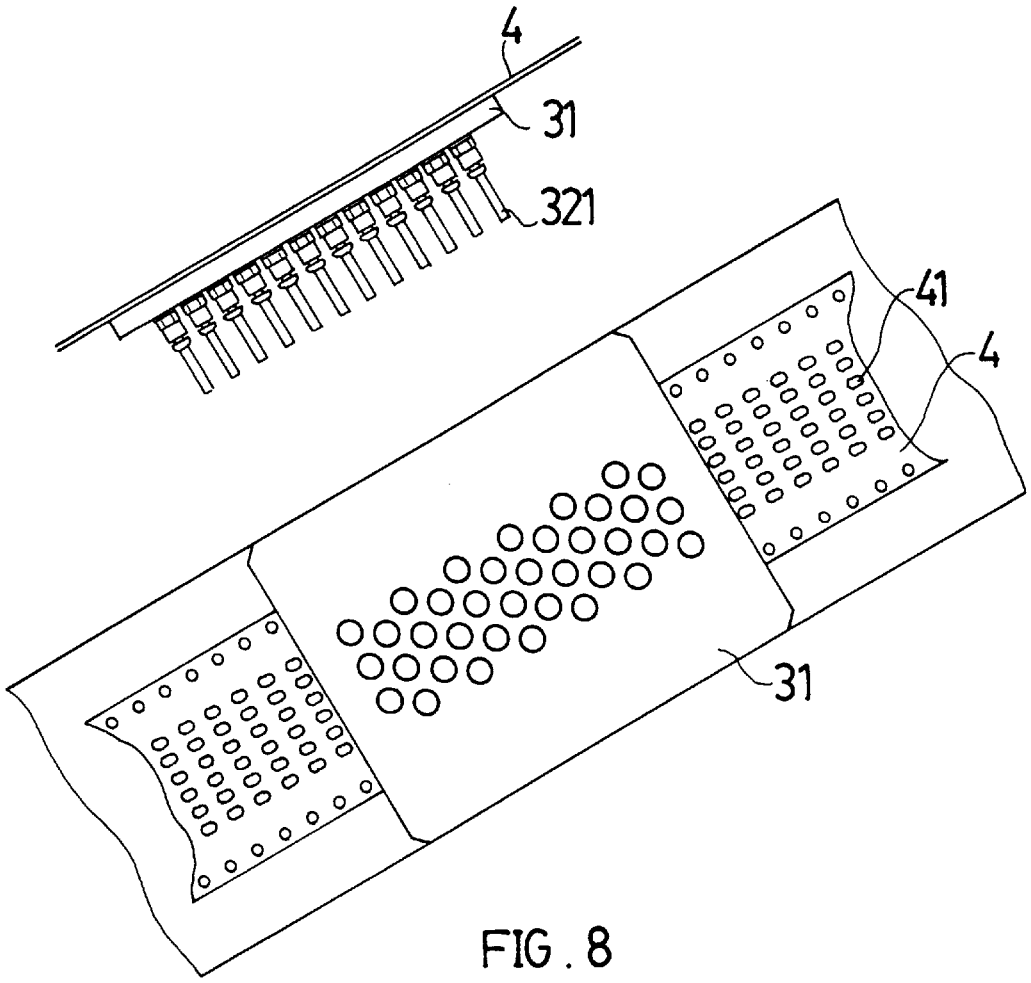
FIG. 8 shows the arrangement of the nozzles of the discharging section of the embodiment of FIG. 2.

Referring to FIG. 8, the discharging device 32 of the discharging section 3 is a parallel type discharging system composed of an electromagnetic valve (not shown), injection nozzles 321 and rice kernel transferring guide tube (not shown). The nozzles 321 are disposed under the conveying belt 4 and the grading guide board 31. In a preferred embodiment, the brown rice is divided into six classifications so that totally 36 nozzles (each row has six sets) are provided. The electromagnetic valve controls the opening/closing of the air flow. During moving of the conveying belt 4, the nozzles 321 are aligned with the carrying holes 41 for blowing the rice kernels out of the carrying holes 41 to go through the transferring guide tube and fall into the collection container (not shown). The downward inclined grading guide board 31 serves to facilitate transferring of the rice kernels. In case it is desired to increase the number of the classifications, the number of the nozzles 321 can be increased.

Figure 9:
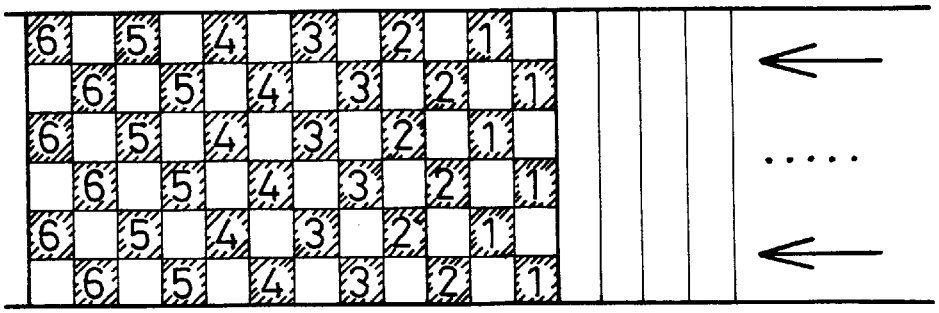
FIG. 9 shows the nozzles of the embodiment of FIG. 2, which correspond to the brown rice classifications.

Referring to FIG. 9, when getting into the discharging section 3 along with the conveying belt 4, each rice kernel at most will pass through six nozzles. (The nozzles are not shown, but denoted by numerals. Numeral 1 represents the first grade. Other numerals represent other grades in a similar manner.) The six nozzles respectively represent six classifications. For example, in the case that the rice kernel pertains to first classification, when passing through the first nozzle, the electromagnetic valve connected to the nozzle is activated and air is injected from the nozzle for blowing the rice kernel into the transferring guide tube (not shown) to fall into the collection container.

It should be noted that the present invention serves to continuously quickly detect the appearance quality of the brown rice. In the above embodiment, the average ratio of the rice kernels filled into the carrying holes is 81%. In the case that the rotary speed of the variable motor for driving the conveying belt is set to be 33 rpm and the air pressure of the nozzle is set to be 4.5 kgw/cm$^2$, the rice kernels can be classified almost completely correctly. In addition, the 36 nozzles serve to process the classification signal independently so that a high efficiency parallelly discharging operation can be achieved.

When detecting and sorting a great amount of brown rices, a correct classification ratio of 80% can be achieved, in which 80% sound kernels (including fissured kernel) can be correctly detected. Moreover, with respect to the collection containers for respective classifications, the sound kernels are collected at a highest correction ratio over 95%. In order to increase the amount of the sorted sound kernels, the rice kernels collected at relatively low correction ratio can be secondarily sorted. This also can increase the correction ratio of this classification of rice kernels collected in the collection container.

It is to be understood that the above description and drawings are only used for illustrating some embodiments of the present invention, not intended to limit the scope thereof. Any variation and derivation from the above description and drawings should be included in the scope of the present invention.

What is claimed is:

1. A grain sorting device comprising a feeding section having a retaining board, a photographing section having a top board and a discharging section having a grading guide board, a conveying belt being wound around the three boards and driven by a motor, the conveying belt being formed with multiple grain carrying holes having a profile similar to that of the grains, the carrying holes being spaced from each other and oriented in the same direction, the feeding section being disposed with a feeding mechanism and a scattering mechanism, the photographing section being disposed with a photographing device, the discharging section being disposed with a discharging device wherein said sorting device has a substantially trapezoidal profile and said retaining board of said feeding section is upwardly inclined.

2. A grain sorting device as claimed in claim 1, wherein each grain carrying hole of the conveying belt has an elliptic shape, a long axis of the carrying hole being parallel to the moving direction of the conveying belt for restricting the orientation of the grain.

3. A grain sorting device as claimed in claim 1, wherein two side of the conveying belt are formed with counting holes in alignment with the carrying holes for counting the moving positions of the grains.

4. A grain sorting device as claimed in claim 1, wherein the feeding mechanism includes a funnel-shaped grain container having a gate at lower end for controlling the amount of the falling down grains, the scattering mechanism being positioned in front of the container, including a rotary brush and a pressing wheel which are driven by a motor to rotate in reverse directions, the ends of the hairs of the rotary brush contacting with the conveying belt, the pressing wheel being disposed with an outer layer of sponge contacting with the conveying belt, the pressing wheel being rotated with a tangential speed faster than that of the conveying belt.

5. A grain sorting method comprising the steps of:

a. separately planely scattering a plurality of grains over predetermined positions of a surface of a conveying belt and orienting the grains in the same direction;

b. using the conveying belt to transfer the separated grains to a photographing section to be photographed and inspected by an electric coupling device;

c. establishing reference parameters for said separated grains including the steps of calculating projection area, ratios of projection area to perimeter, long/short axis ratios after Hotelling transfer, mean value of red-gray levels, mean value of green-gray levels, mean value of blue-gray levels, ratios of green light component to red light component and chalky area ratios;

d. comparing said reference parameters with data stored in a computer:

e. sorting said grains into classifications defining sound kernels, discolored kernels, immature kernels, abnormal kernels and rice screenings: and, f. according to the comparison results, using a programmable controller to transmit signals to electromagnetic valves corresponding to the grains, enabling these valves to inject high pressure air for blowing the grains into corresponding collection containers.

6. The grain sorting method as claimed in claim 5, wherein the step of establishing reference parameters includes the step of calculating, compactness, the sum of differences between four subsidiary short axes and ma in short axes, the sum of absolute values of differences between four subsidiary short axes and main short axes, standard deviation of red gray level, standard deviation of green gray level, standard deviation of blue gray level.

* * * * *